United States Patent [19]

Ulmen

[11] Patent Number: 4,590,873

[45] Date of Patent: May 27, 1986

[54] SEWING ASSEMBLY WITH A SEWING MACHINE MOVABLE ALONG THE WORK

[75] Inventor: Mathias Ulmen, Kindsbach, Fed. Rep. of Germany

[73] Assignee: Pfaff Industriemaschinen GmbH, Fed. Rep. of Germany

[21] Appl. No.: 693,011

[22] Filed: Jan. 18, 1985

[30] Foreign Application Priority Data

Jan. 20, 1984 [DE] Fed. Rep. of Germany ... 8401548[U]

[51] Int. Cl.[4] ..... D05B 3/00

[52] U.S. Cl. ..... 112/121.14

[58] Field of Search ..... 112/121.14, 3 R

[56] References Cited

U.S. PATENT DOCUMENTS

| | | | |
|---|---|---|---|
| 1,481,994 | 1/1924 | Droll | 112/3 R |
| 1,649,319 | 11/1927 | Molyneux | 112/121.14 |
| 2,062,359 | 12/1936 | Gail | 112/3 R |
| 2,791,344 | 5/1957 | Kalning et al. | 112/2 |
| 3,450,076 | 6/1969 | Bender | 112/2 |
| 3,765,349 | 10/1973 | Gerber | 112/121.14 |
| 3,847,097 | 11/1974 | Dusch et al. | 112/121.14 |
| 3,943,864 | 3/1976 | Freighery et al. | 112/121.14 |
| 4,416,125 | 11/1983 | Dietrich | 69/47 |
| 4,434,731 | 3/1984 | Beisler | 112/121.14 |

FOREIGN PATENT DOCUMENTS

| | | | |
|---|---|---|---|
| 723049 | 2/1955 | United Kingdom | 112/3 |

*Primary Examiner*—Werner H. Schroeder
*Assistant Examiner*—Joseph S. Machuga
*Attorney, Agent, or Firm*—McGlew and Tuttle

[57] ABSTRACT

A sewing machine assembly comprises a work holding device which is mounted in a fixed location on a support such that a sewing machine carriage frame is movable toward and away from the workpiece holding device. The sewing machine carriage frame carries a support for the sewing machine which is movable transversely relative to the workpiece holding device by cog belts which are driven by a rotatable motor so that the sewing machine support moves backwardly and forwardly. The sewing machine is also mounted on a resilient support of a plate and an eccentric motion is imparted to the sewing machine by a driving motor and an oscillatory motion is imparted to the sewing machine in addition to its relative movement in respect to the holding device.

5 Claims, 3 Drawing Figures

SEWING ASSEMBLY WITH A SEWING MACHINE MOVABLE ALONG THE WORK

FIELD AND BACKGROUND OF THE INVENTION

This invention relates in general to sewing devices and in particular to a new and useful sewing assembly which includes a sewing machine which is movable along the work.

A sewing assembly similar to the present invention is disclosed in U.S. Pat. No. 4,416,125. That prior art sewing assembly forms a part of an automatic machine for letting out furskins. The sewing machine for sewing together furskin strips is displaceably supported on a horizontal guide rail and a splined shaft parallel thereto. The splined shaft is connected to a motor and drives through an internally geared wheel the mechanism of the sewing machine. The sewing machine is connected through a cog belt to a stepping motor by which the sewing machine is displaced intermittently in synchronism with the stitch formation along the furskin strips clamped in a holding device.

Experience has shown that with such drive systems, because of the elasticity of the cog belt, the transmission of the intermittent advance movements of the stepping motor becomes increasingly inaccurate with the increasing amount of displacement, thus the increasing length of the cog belt. In addition, such a drive system tends to oscillate at certain frequencies. Further, the use of a stepping motor requires an expensive control circuit for synchronizing the individual advance steps with the stitch forming operation of the machine.

SUMMARY OF THE INVENTION

The invention is directed to a sewing assembly in which an intermittent advance of the sewing machine synchronous with the stitch forming operation is effected in a more simple and reliable manner.

From German Pat. No. 11 58 800, there is known a sewing assembly comprising a sewing head which is continuously movable relative to the work. The needle bar and the hook member are mounted each in a frame movable within the sewing head. The frames are moved by cam drives back and forth in synchronism with the needle bar and parallel to the plane of the work in a manner such that with the needle stuck in the work, the needle and the hook member stand still in a position parallel to the work plane, while with the needle outside the work, the needle and the hook member are moved at an increased speed after the sewing head which was advanced in the meantime. That sewing assembly thus already provides an intermittent relative motion between the work holding device and the sewing machine, by superimposing an oscillatory motion synchronous with the stitch formation on a continuous advance motion. However, this result is obtained at extraordinarily high costs.

In contradistinction thereto, in the inventive assembly, a conventional sewing machine with an unchanged needle bar and hook member drive can be employed. In an automatic machine for letting out furskins, it is advisable to employ a cup feed type sewing machine where only the feed cups are to be removed.

A development of the invention in which the sewing machine is mounted on a plate which is movable on the guide means and connected to the drive means, and the eccentric of the eccentric drive is secured to a shaft rotating in synchronism with the stitch formation and the eccentric rod is hinged to the plate and provides a particularly simple synchronization of the oscillatory movement of the sewing machine with the reciprocating movement of the needle bar, by securing the eccentric of the eccentric drive to the armshaft of the sewing machine.

Another development is to provide an eccentric drive which is adjustable and makes it possible to adapt the amplitude of the oscillatory movements of the sewing machine to a changed stitch length by simply adjusting the eccentricity.

Accordingly it is an object of the present invention to provide a sewing assembly wherein a sewing machine is carried on a frame which is movable relative to a workpiece holding device and in which the workpiece is movable transversely to the holding device and is also imparted with an eccentric oscillatory motion.

A further object of the invention is to provide a sewing device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
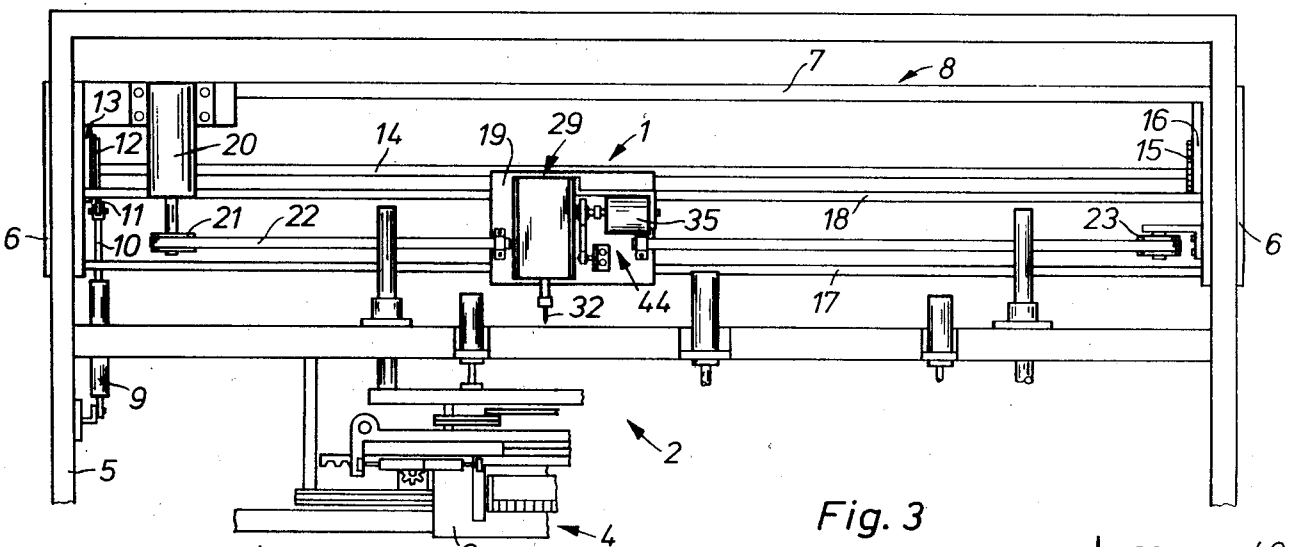
FIG. 1 is a top plan view of the sewing assembly and of a part of the automatic machine for letting out furskins.
Figure 3:
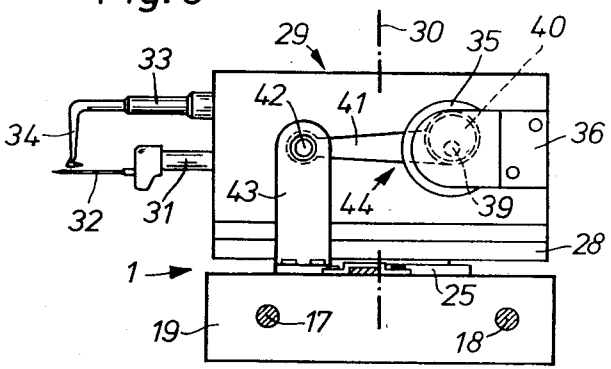
FIG. 3 is a side view of the sewing machine and the eccentric drive.
Figure 2:
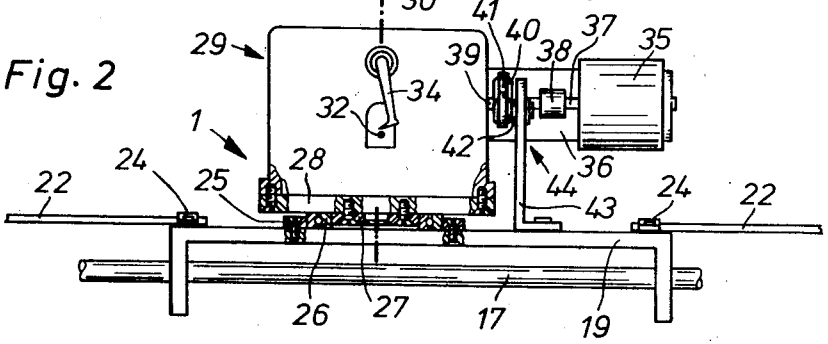
FIG. 2 is a partly sectional front view of the sewing machine and the eccentric drive.

Referring to the drawings in particular the invention embodied therein comprises a sewing assembly which includes a workpiece holder 4 on which a workpiece is held on a fixed support 5 as a sewing machine 29 is moved along the work. It will effect the movement of the sewing machine and is carried on a frame 8 which moves toward and away from the workpiece holding device 4, in addition the support plate 19 on which the sewing machine is mounted is shifted transversely relative to the holding device 4. The construction is such that an oscillatory motion is also imparted to the sewing machine through an eccentric drive 44.

The machine 2 comprises two clamping jaws of which only the rear jaw 3 is shown. The clamping jaws form together with the guide and drive elements (not specified in detail) a holding device 4 for the work during the sewing operation.

Machine 2 further comprises a supporting structure 5 on which two sliding heads 6 are displaceable. The heads are connected to each other by a rigid bar to form a frame 8. Frame 8 is movable on the supporting structure by means of an air cylinder 9, the piston rod 10 thereof, a lever 11, and a gear 12. Gear 12 meshes with a gear rack 13 which is secured to frame 8. Gear 12 is also connected, by a rod which is stiff against torsion, to another gear, 15 meshing with another gear rack 16 also secured to frame 8.

Frame 8 further comprises two guide rods 17, 18 secured thereto and extending in parallel. A plate 19 is mounted for sliding on rods 17,18. Frame 8 also carries a motor 20 for driving a cog belt 22 through a cog wheel 21. Cog belt 22 is trained about a tail wheel 23 and connected to plate 19 by two clamps 24.

Secured to the plate 19 is an outer holding ring 25 into which an antifriction bearing is force-fitted. Antifriction bearing 26 carries an inner holding ring 27 again press-fitted therein. To ring 27, a plate 28 is secured carrying the sewing machine 29. Plate 28 and sewing machine 29 are together oscillatable about an axis 30 which extends transversely to guide rods 17,18.

Sewing machine 29 is of the cup feed type. However, the feed cups are removed. To form single-thread chain stitches, the sewing machine is equipped with a needle bar 31 movable back and forth in a horizontal plane and carrying a needle 32, and a hook member bar 33 carrying a hook member or looper 34. Sewing machine 29 is driven by a brake motor 35 which is secured to the sewing machine 29 through an angle plate 36 and whose shaft 37 is firmly connected to the armshaft 39 of the sewing machine 29 through a clutch 38.

Armshaft 39 carries an eccentric 40 having a spherical surface. Eccentric 40 is embraced by one end of an eccentric rod 41 having its other end mounted on the spherical head of a bolt 42. Bolt 42 is supported by an angle plate 43 which is secured to plate 19. Elements 40, 43 form together an eccentric drive 44.

The sewing assembly operates as follows:

To effect the sewing operation, sewing assembly 1 is brought into sewing position by displacing frame 8 by means of air cylinder 9 from its rest position shown in FIG. 1 in the direction of holding device 4. Then, motor 20 is switched on, whereby plate 19 with sewing machine 29 is displaced from its rest position to the work.

As soon as needle 32 reaches the work, brake motor 35 is switched on, thus sewing machine 29 is put in operation. Since eccentric rod 41 is hinged to blot 42 which is fixed relative to the plate 19, eccentric 40, which is secured to armshaft 39, causes oscillatory movements in a horizontal plane about axis 30, of armshaft 39 and thus of sewing machine 29 and plate 28.

The oscillatory movements of sewing machine 29 which are synchronous with the stitch forming operation are superimposed on the continuous advance motion of the sewing machine effected by motor 20, in a manner such that needle 32 moves intermittently relative to holding device 4 in a direction substantially parallel to the advance direction of sewing machine 29. Eccentric 40 is so adjusted that this intermittent motion of the needle stops just in the time periods during which the needle is stuck in the work. In this way, no lateral forces act on needle 32 and no risk is run that needle would break or be deflected to an extent causing a collision with the hook member 34.

Should the speed of motor 20 or of brake motor 35 be changed in order to change the stitch length, the amplitude of the oscillatory movements of sewing machine 29 must be adjusted thereto. This may be done, for example, by exchanging eccentric 40 for an another eccentric. Another possibility is to substitute for eccentric 40 having a constant eccentricity, an eccentric device having an adjustable eccentricity. Such a device is disclosed in German patent No. 699, 973, for example.

While specific embodiments of the invention have been shown and described in detail to illustrate the application of the principles of the invention, it will be understood that the invention may be embodied otherwise without departing from such principles.

What is claimed is:

1. A sewing assembly comprising a work holding device, a sewing machine support, a sewing machine carried by said support and being pivotal thereon, a motor driving said sewing machine, and guide and drive means for effecting a relative motion between said workpiece holding device and said sewing machine, said sewing machine being mounted on said support for pivoting about an axis which extends transversely to said guide and drive means, and an eccentric drive on said support connected to said sewing machine to effect an oscillatory motion thereon superimposed on said relative motion.

2. A sewing assembly according to claim 1, wherein said guide and drive means includes a frame carrying said sewing machine support plate, and means connected to said frame for shifting it toward and away from said workpiece holding device.

3. A sewing assembly according to claim 2, wherein said eccentric drive includes a motor having a rotatable motor shaft and a sewing machine armshaft carried by said sewing machine and an eccentric drive between said armshaft and said motor shaft.

4. A sewing assembly according to claim 3, wherein said eccentric includes a rod hinged to said support, said eccentric being adjustable.

5. A sewing assembly according to claim 1, including a support carrying said workpiece holding device, a frame movable backwardly and forwardly on said support, said guide and drive means comprising said frame and including a air cylinder mounted on said support having a piston connected to said plate for shifting said frame, a gear pulley system mounted on said frame including a driving motor driving one of said gear pulleys and a cog belt guided over said pulleys and having each end connected to said support for said sewing machine, said cog belt being drivable to shift the sewing machine transversely in respect to said workpiece holding device.

* * * * *